US009036321B2

(12) United States Patent
Schütz

(10) Patent No.: US 9,036,321 B2
(45) Date of Patent: May 19, 2015

(54) TRANSPORT AND STORAGE CONTAINER FOR LIQUIDS

(75) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 677 days.

(21) Appl. No.: 13/224,133

(22) Filed: Sep. 1, 2011

(65) Prior Publication Data

US 2012/0074138 A1 Mar. 29, 2012

(30) Foreign Application Priority Data

Sep. 28, 2010 (DE) ..... 10 2010 041 545

(51) Int. Cl.
*H05F 3/02* (2006.01)
*B65D 77/04* (2006.01)

(52) U.S. Cl.
CPC ..... *B65D 77/0466* (2013.01); *B65D 2213/02* (2013.01); *B65D 2519/00164* (2013.01); *B65D 2519/00502* (2013.01); *B65D 2519/00512* (2013.01)

(58) Field of Classification Search
CPC ..... B65D 2213/02
USPC ..... 361/212
See application file for complete search history.

(56) References Cited

U.S. PATENT DOCUMENTS

| | | | |
|---|---|---|---|
| 5,253,776 | A | 10/1993 | Decroix et al. |
| 5,365,858 | A | 11/1994 | Kuhns |
| 5,971,185 | A | 10/1999 | Schutz |
| 7,165,694 | B2 | 1/2007 | Schütz |
| 7,908,980 | B2 | 3/2011 | Schmidt et al. |
| 7,913,850 | B2 | 3/2011 | Schütz |
| 2005/0087531 | A1 | 4/2005 | Schutz |
| 2009/0000525 | A1 | 1/2009 | Schmidt et al. |
| 2012/0211395 | A1 | 8/2012 | Schutz |

FOREIGN PATENT DOCUMENTS

| | | | |
|---|---|---|---|
| CN | 1067020 | A | 12/1992 |
| CN | 1611420 | A | 5/2005 |
| CN | 101508378 | A | 8/2009 |
| CN | 101519150 | A | 9/2009 |
| DE | 20206652 | A | 8/2002 |
| DE | 202006001222 | Y | 5/2007 |
| EP | 1481918 | | 12/2004 |
| EP | 2090520 | A | 8/2009 |
| JP | 1129144 | | 2/1999 |
| JP | 2006021800 | | 1/2006 |
| JP | 2009523674 | | 6/2009 |

*Primary Examiner* — Thienvu Tran
*Assistant Examiner* — Ann Hoang
(74) *Attorney, Agent, or Firm* — McGlew and Tuttle, P.C.

(57) ABSTRACT

A transport and storage container for liquids, having an inner container, an outer casing and an underframe with a bottom for supporting the inner container, and electrically non-conductive support legs. At least one support leg has a shaped sheet metal part to dissipate an electrostatic charge from the inner container. The end of the shaped part closest to the inner container has a container contact section for conductive connection with the bottom or the outer casing, and a standing contact section for conductive connection with the standing surface. The contact conductor section of the shaped part extends inside a cavity in the support leg and the standing contact section has a ground contact surface and a stack contact surface. These contact surfaces are connected by an offset element in the standing contact section and the stack contact surface is arranged above the ground contact surface in a vertical direction.

12 Claims, 2 Drawing Sheets

Fig. 2
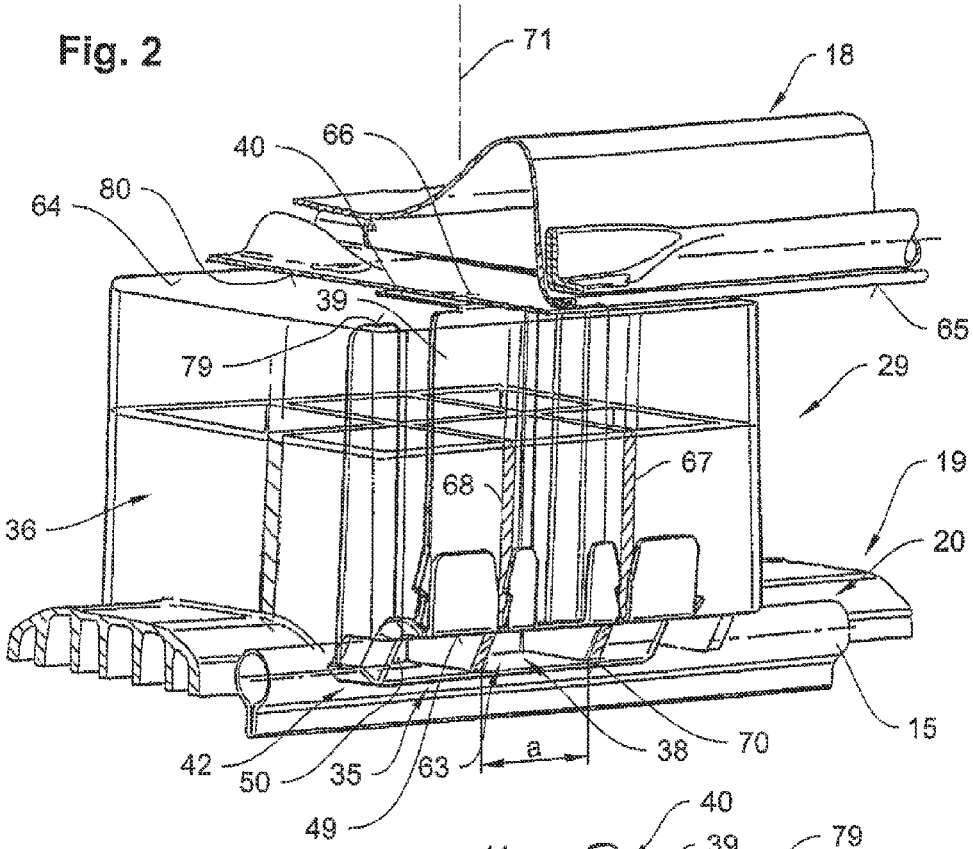
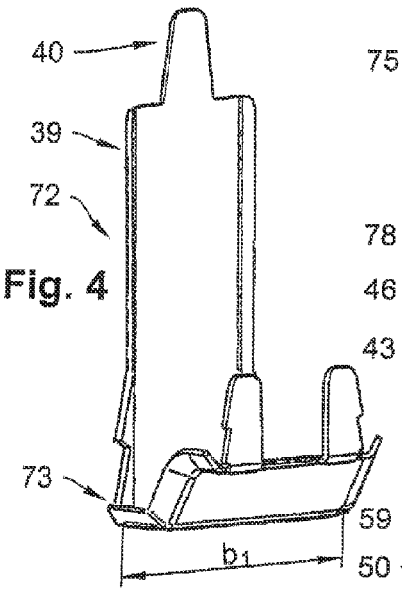
Fig. 4
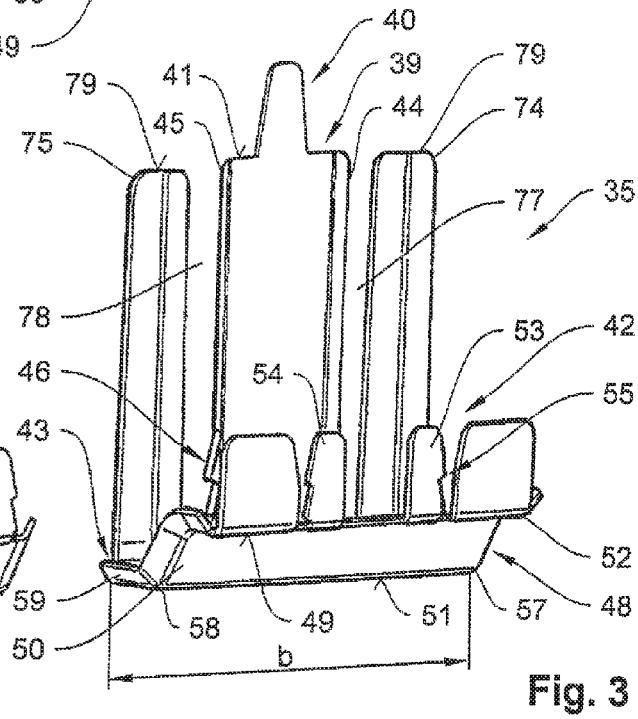
Fig. 3

TRANSPORT AND STORAGE CONTAINER FOR LIQUIDS

The present invention relates to a transport and storage container for liquids, having an inner container made of plastic, an outer casing consisting particularly of a metal mesh or sheet metal, and an underframe constructed in the form of a pallet which is configured to be manipulated by a lifting truck, shelf operating device or similar transport devices, wherein the underframe has a bottom for supporting the inner container, and support legs made from an electrically non-conductive material, wherein the bottom is arranged with a peripheral edge between a bottom edge of the outer casing and the support legs, and at least one support leg is furnished with a shaped sheet metal part to dissipate an electrostatic charge from the inner container, which is enclosed in the outer casing and disposed on the bottom, the contact conductor section at the end of the shaped sheet metal part closest to the inner container having a container contact section for electrically conductive connection with the bottom or the outer casing and a standing contact section for electrically conductive connection with the standing surface at the end closest to the standing surface.

When manipulating transport and storage containers of the type described in the introduction, or also when such containers are filled and emptied, the liquids contained in the inner container are set in motion relative to the shell of the inner container. If the inner container is not equipped with a suitable device for dissipating an electrostatic charge, these relative movements are capable of creating a potential in the container, which in turn poses a danger that the contents of the container may ignite. In order to avoid this risk, transport and storage containers of the type described in the introduction are furnished with devices that enable any electrostatic charge that is created in the plastic inner container to be dissipated, starting from the shell of the inner container, through the outer casing of the container and pallet-like underframe of the container to the standing surface on which the container is disposed. Particularly if the pallet-like underframe, or at least the support legs of the pallet-like underframe, which are in direct contact with the standing surface, are made from an electrically non-conductive material, for example plastic or wood, it is also necessary to make special arrangements regarding the pallet-like underframe to enable the desired dissipation of any electrostatic charge of the inner container, that is to say to "earth" the inner container.

From EP 1 481 918 A1 is known a transport and storage container of the type described in the introduction that is furnished with a pallet-like underframe, of which the support legs are made of wood. To create an electrically conductive connection between the outer casing of the transport and storage container and the standing surface, it is suggested to provide a metal strip along the outside of the support legs, enabling the desired dissipation of an electrostatic charge. The attachment of the metal strip to the outside of the support legs means that it is in an exposed position, and there is a danger of the metal strip being damaged, or even becoming detached, particularly in the event of relative movements of transport and storage containers located in close proximity on a standing surface, so that the intended electrostatic dissipation by the metal strip is no longer assured. Moreover, attaching the metal strip to the support leg requires the use of additional mechanical fastening means.

The object underlying the present invention is therefore to suggest a transport and storage container that is furnished with a device for dissipating electrostatic charge of the inner container created in the area of the underframe particularly by relative movements of the liquids with regard to the inner container, which device is operationally secure, and in particular protected from external mechanical influences.

In order to solve this object, the transport and storage container according to the invention has the features of claim 1.

According to the invention, the contact conductor section of the shaped sheet metal part extends inside an accommodation cavity conformed in the support leg and the standing contact section has a contact surface arrangement with a ground contact surface and a stack contact surface, the stack contact surface being connected to the ground contact surface via a contact surface offset element conformed in the standing contact section and disposed above the ground contact surface in the direction of a vertical axis of the container.

Because of the internal arrangement of the contact conductor section of the shaped sheet metal part, in the accommodating cavity in the support leg in question, the shaped sheet metal part, or the contact conductor section, is located in a position that is shielded from external mechanical influences, so that, particularly if several transport and storage containers are located in the immediate vicinity, it is possible to be prevent the shaped sheet metal part from being damaged by "snagging" on the adjacent pallet-like underframes of the transport and storage containers.

In addition, according to the inventive design the standing contact section is furnished with a contact surface arrangement, which not only enables a single container to be earthed securely to a standing surface but also assures secure earthing contact for a stacked arrangement of multiple transport and storage containers arranged one on top of the other. In the first case, the earthing contact is established between the ground contact surface and the standing surface. In the second case, an electrically conductive contact is established between the shaped sheet metal part of a transport and storage container arranged on top of another transport and storage container in a stacking configuration via the stack contact surface located adjacent to the ground contact surface because the stack contact surface, by virtue of its position relative to the ground contact surface, comes into direct contact with the upper edge of the outer casing of the other transport and storage container located underneath it. In this way, the contact surface offset between the ground contact surface and the stack contact surface helps to ensure that the transport and storage containers are retained securely in the correct position relative to each other.

If, as in a preferred embodiment, the end of the support leg closest to the standing surface has a correspondingly conformed support surface arrangement for bracing the standing contact section, the standing contact section may be reinforced so that even very thin strips of sheet metal may be chosen for the shaped sheet metal part or the standing contact section without jeopardising the dimensional stability of the contact surface offset element conformed in the standing contact section.

It is particularly advantageous if the container contact section is constructed as a fastening element for fastening the shaped sheet metal part to the support leg, so that additional mechanical fastening means for fastening the shaped sheet metal part to the support leg may be dispensed with.

In a preferred embodiment, the container contact section is constructed as a flexible tongue that may be passed through a fastening slot conformed in a supporting base and bent towards the supporting base in such manner that the flexible tongue is accommodated between the supporting base and the bottom. If the container contact section is designed as flexible tongue, the container contact section is thus able to perform a second function at the same time as a fastening means. Moreover, the arrangement of the flexible tongue is particularly advantageously selected so that it is positioned between the bottom and the support base, thus protecting the flexible tongue against inadvertent bending and the associated danger of losing the connection between the shaped sheet metal part and the support leg.

If, in accordance with a preferred embodiment, the shaped sheet metal part is essentially L-shaped, so that the standing contact section extends perpendicularly to the contact conductor section, and the container contact section is constructed as a continuation of an abutment end of the contact conductor section opposite the standing contact section, a particularly simple option is created for installing the shaped sheet metal part in the support leg, in which the shaped sheet metal part is inserted in the accommodating cavity from below until the abutment end of the contact conductor section comes to rest against the support base, thus defining the correct positioning of the shaped sheet metal part.

For the purposes of a mechanically secure support for the standing contact section of the shaped sheet metal part it has proven particularly advantageous if the standing contact section is supported on frontal edges of cavity walls of the accommodating cavity.

A particularly secure positioning of the shaped sheet metal part in the support leg that prevents relative movements thereof is enabled if the standing contact section is furnished with retaining devices at the edge thereof that connects with the contact conductor section and at the free outer edge thereof opposite the connecting edge in order to fix the position of the standing contact section in the accommodating cavity.

A particularly simple and also operationally secure configuration of the retaining devices is achieved if the retaining devices allocated to the connecting edge are constructed as detent devices that engage with the longitudinal edges of the contact conductor section, and which form a positive and non-positive locking connection with the walls of the accommodating cavity.

A correspondingly secure positioning and simple construction of the retaining devices allocated to the free, outer edge is achieved if they have the form of cleats constructed as material extensions on the free outer edge and extend parallel to the longitudinal edges of the contact conductor section.

An undesirable deformation of the standing contact section due to shifting of the transport and storage containers along the ground or on the top edge of the outer casing of a lower container in a stacked configuration, as frequently happens in practice, may be prevented if the standing contact section is furnished with fins on the transverse edges extending between the connecting edge and the free outer edge of the standing contact section, which fins are positioned facing the ground contact surface and the stack contact surface and inclined towards the container contact section.

If the connecting edge of the standing contact section is furnished with bearing flanges, each of which extends parallel to the longitudinal edges of the contact conductor section, and which are separated by cutouts for seating the walls of the accommodating cavity and lie flush with the underside of the support base for bracing the transverse edges of the standing contact section, deformation-resistant constructions of standing contact sections are possible that extend beyond the cross-section of the accommodating cavity in the support leg.

In the following, preferred embodiments will be explained in greater detail with reference to the drawing. In the drawing:

FIG. 2 is a detailed view II of the transport and storage containers shown in stacked configuration in FIG. 1 with a representation of a shaped sheet metal part inserted in a central support leg of a outer skid of a skid pallet as an earthing plate;

FIG. 3 is an isometric illustration of the shaped sheet metal inserted in the support leg shown in FIG. 2;

FIG. 4 is an isometric illustration of another embodiment of the shaped sheet metal part.

Figure 1:
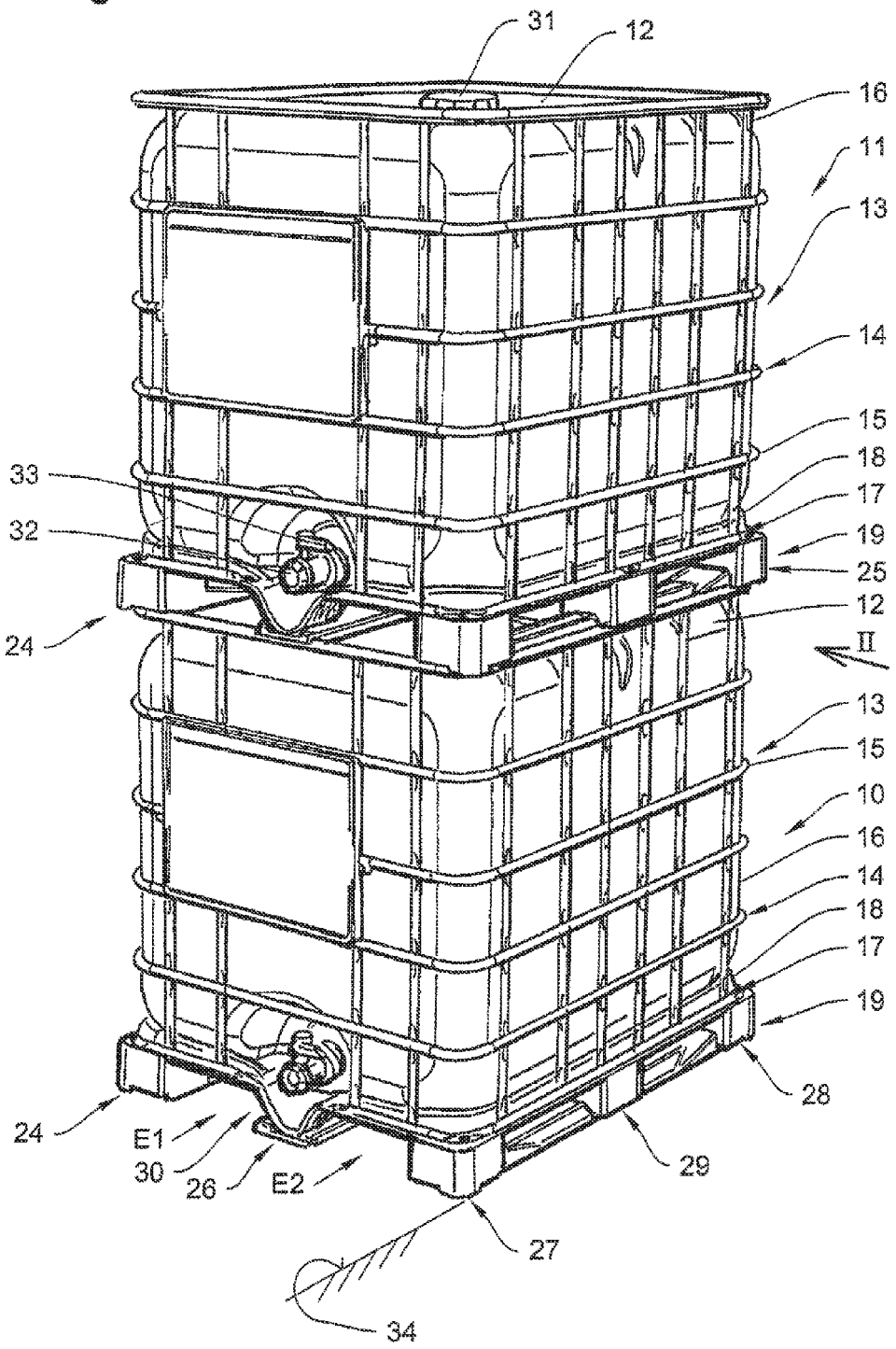
FIG. 1 shows two transport and storage containers for liquids in a stacked configuration.

FIG. 1 shows two transport and storage containers 10 and 11 stacked one on top of the other, each of which comprises a container 12 made from plastic that is arranged inside a casing structure 13 to protect container 12 from mechanical stresses. Casing structure 13 has an outer casing 14, which in the present case is constructed of a plurality of horizontal bars 15 and vertical bars 16 crossing each other to form a cage structure.

Bottom edge 17 of outer casing 14, in the present case constructed as a bottom bar horizontal bar 15, rests on a bottom 18 and has an underframe represented here as a skid pallet 19.

In the present case, skid pallet 19 has three skids arranged parallel to each other, two outer skids 24, 25, and one centre skid 26, which are set at such a distance from each other that spaces $E_1$, $E_2$ are created between left outer skid 24 and centre skid 26 and between centre skid 26 and right outer skid 25 so that the forks of a forklift truck, not shown here, can be introduced into them for transporting transport and storage containers 10, 11.

Skid pallet 19 is furnished with two corner legs 27, 28 and one centre leg 29 on each of the outer skids 24, 25, whereas the centre skid has only a centre leg at the rear end thereof, which is not shown in FIG. 1, and which is positioned level with the two rear corner legs 28 of outer skids 24, 25. At the front end of centre skid 26, bottom 18 has a bottom depression 30 which enables support to be provided for bottom 18. In order to support a middle area of bottom 18, centre support legs 29 of outer skids 24, 25 are connected to each other via a bottom cross member 80 (FIG. 2) that reinforces bottom 18.

The plastic inner containers 12 disposed inside outer casings 14 on skid pallets 19 are each provided with a closable filling opening 31 and a draw-off fitting 32 located in the area of bottom depression 30 on inner container 12, so that inner containers 12 may be filled with liquid, which may be drawn off from inner containers 12 again as needed by operating a valve device 33 of draw-off fitting 32.

Particularly when transport and storage containers 10, are used for transporting or storing liquids that include explosive components or form readily ignitable gases in the liquid container, there is a danger that inner containers 12 may become electrostatically charged when inner containers 12 are filled or emptied because of the friction between the liquid and the shell of inner container 12, which in turn may cause the liquid or the gases formed by the liquid to ignite. In order to avoid electrostatic charging of the shell of inner containers 12, means are therefore provided that enable the electrostatic charge of the shell of inner containers 12 to be dissipated to a standing surface 34 of transport and storage container 10. For this purpose, the transport and storage containers 10, 11 illustrated in FIG. 1 are equipped with conducting means, not shown here, which enable an electrically conductive connection between the shell of inner containers 12 and the respective outer casings 14. In addition, an electrically conductive connection is formed by contact of bottom edge 17 of outer casing 14 with the electrically conductive bottom 18.

To provide additional means for dissipating any electrostatic charge, according to the embodiment shown in FIG. 1 a shaped sheet metal part 35, shown in FIG. 2, is provided on the center support leg 29 of at least one outer skid 24, 25. The shaped sheet metal part 35 of the lower transport and storage container 10 enables an electrically conductive connection between bottom 18 and standing surface 34, and the shaped sheet metal part 35 of the upper transport and storage container 11 in the stack configuration enables an electrically conductive connection between the bottom 18 of upper transport and storage container 11 and outer casing 14 of lower transport and storage container 10.

FIG. 2 shows an enlarged detail view of part of centre support leg 29 on skid pallet 19 of upper transport and storage container 11, in a view indicated by arrow II in FIG. 1. Centre support leg 29 has an inner structure 36 that is divided into cavities, wherein one accommodating cavity 38 serves to accommodate shaped sheet metal part 35.

In order to explain the shape of shaped sheet metal part 35, reference is first made to FIG. 3, which shows shaped sheet metal part 35 on its own. According to this, shaped sheet metal part 35 has a contact conductor section 39 that is essentially in the form of a straight strip, the top end of which is furnished with a container contact section 40, which is constructed as a tongue-like continuation on an abutment end 41 of contact conductor section 39. The opposite end of contact conductor section 39 to abutment end 41 becomes a standing contact section 42, which continues contact conductor section 39, transversely thereto and in the present case describing an angle of about 90° relative thereto, so that shaped sheet metal part 35 is essentially L-shaped.

In the area of a connecting edge 43 conformed in the transition from contact conductor section 39 to standing contact section 42, the ends of contact conductor section 39 are furnished with contact conductor fins 44, 45, each of which has a detent device 46.

Standing contact surface 42 has a contact surface element 48 with a stack contact surface 49 and a ground contact surface 51 that is separated from stack contact surface 49 by a contact surface offset element 50. Cleats 53, 54 are conformed on an outer edge 52 opposite contact surface offset element 50 and each is furnished with a detent device 55, which in the present case are of the same construction as detent device 46 on contact conductor section 39. Cleats 53, 54 are separated from contact conductor section 39 by standing contact section 42 and extend essentially parallel to contact conductor fins 44, 45 of contact conductor section 39.

Fins 59 are conformed on transverse edges 57, 58, which extend between connecting edge 43 and outer edge 52 of standing contact section 42, and these fins are inclined towards container contact section 40 opposite stack contact surface 49 or ground contact surface 51.

As is shown in FIG. 2, the shaped sheet metal part 35 installed in centre support leg 29 is seated with its contact conductor section 39 in accommodating cavity 38 of centre support leg 29, the lower end of which cavity having an insertion opening 63 and the upper end thereof being closed by a support base 64 of support leg 29. In order to install shaped sheet metal part 35 in accommodating cavity 38, shaped sheet metal part 35 is inserted into accommodating cavity 38 from below through insertion opening 63 before bottom 18 is assembled with the underside 65 thereof facing support base 64 of support leg 29. In so doing, container contact section 40 is inserted into a fastening slot 66 in support base 64 until abutment end 41 (FIG. 3) lies flush against the underside of support base 64. At the same time, detent devices 55 conformed in the area of connecting edge 43 (FIG. 3) on contact conductor fins 44, 45 and detent devices 55 conformed on cleats 53, 54 are pressed into accommodating cavity 38 against the deformation resistance of adjacent cavity walls 67, 68, so that detent devices 46 and 55 create an engagement connection with cavity walls 67, 68. Since insertion opening 63 of neighbouring frontal edges 70 of cavity walls 67, 68 have a contour that approximately matches a Z-shaped cross-section of standing contact section 42, accommodating cavity 38 together with cavity walls 67, 68 forms supporting surface arrangement for bracing standing contact section 42.

As FIG. 2 also shows, contact surface offset element 50 enables both a vertical offset of stack contact surface 49 relative to ground contact surface 51 in the direction of a container vertical axis 71 and a horizontal offset of stack contact surface 49 relative to ground contact surface 51, with the result that an upper edge 20 of the lower transport and storage container 10 shown in FIG. 1 formed by a horizontal bar 15 lies flush against standing contact section 42 in a manner defined both vertically and horizontally when the container is in the stacked configuration. In this case, stack contact surface 49 ensures that electrical contact in the vertical direction is secure and contact surface offset element 50 ensures that upper transport and storage container 11 shown in the stacked configuration in FIG. 1 is secured horizontally on top of lower transport and storage container 10, thereby ensuring not only a reliable electrical contact, but also the stability of the stacking arrangement.

As FIG. 2 also shows when considered together with FIG. 1, ground contact surface 51 of shaped sheet metal part 35 enables direct contact between shaped sheet metal part 35 and standing surface 34 when transport and storage container 11 is placed on standing surface 34. In the embodiment shown here, ground contact surface 51 is slightly rounded, because transverse edges 57, 58 of standing contact section 42 are slightly bent in the area of ground contact surface 51, so that it is still possible to shift transport and storage container 10 or 11 on standing surface 34 or upper edge 20 respectively. In the embodiment shown here, transverse edges 57, 58 of standing contact section 42 are furnished with a lip 59, 60 in order to compensate for any more substantial unevennesses on a subsurface defined by standing surface 34 or upper edge 20.

Standing contact section 42 of shaped sheet metal part 35 is provided with additional supporting tabs (bearing flanges) 74, 75 adjacent to transverse edges 57, 58, each of these tabs extending parallel to contact conductor section 39 and separated from each other by a cutout 77, 78. The free ends of each of the supporting tabs 74, 75 have a reinforcing edge 79, which creates a flush contact against the underside of support base 64.

As was explained in the introduction, shaped sheet metal part 35 is inserted into accommodating cavity 38 before bottom 18 is assembled with the underside 65 thereof against support base 64 of support leg 29. After shaped sheet metal part 35 has been inserted into accommodating cavity 38 and abutment end 41 of contact conductor section 39 is lying flush against the underside of support base 64, the tab-shaped container contact section 40 is bent towards support base 64, thereby creating an additional mechanical connection between shaped sheet metal part 35 and support leg 29 in addition to detent devices 46 and 55. Then, bottom 18 with its underside 65 and the base crosspiece 80 disposed on the underside 65 thereof is bolted to support base 64, so that container contact section 40 is seated between support base 64 and bottom 18 and locked in a configuration in which it is bent towards support base 64.

When shaped sheet metal part 35 is installed in support leg 29, cutouts 77, 78 serve to accommodate cavity walls 67, 68, so that the arrangement of supporting tabs 74, 75 adjacent to cutouts 77, 78 enables standing contact section 42 to be braced securely even when standing contact section 42 has a width b that exceeds the distance a between cavity walls 67, 68.

FIG. 4 shows another embodiment of shaped sheet metal part 72 which differs from shaped sheet metal part 35 in that it has a standing contact section 73, width $b_1$ of which is adapted to distance a between cavity walls 67, 68, so that unlike with shaped sheet metal part 35 no additional supporting tabs are necessary for ensure reliable bracing. In other respects, the construction of shaped sheet metal part 72 is essentially consistent with that of shaped sheet metal part 35 and it has a contact conductor section 39 of which the end opposite standing contact section 73 is furnished with a container contact section 40.

The invention claimed is:

1. A transport and storage container for liquids, comprising:

an inner container made of plastic;

an outer casing made of a metal mesh or sheet metal; and an underframe constructed as a pallet configured to be manipulated by a lifting truck, a shelf operating device or similar transport device, wherein the underframe has a bottom for supporting the inner container, and support legs made from an electrically non-conductive material, wherein the bottom is arranged with a peripheral edge between a bottom edge of the outer casing and the support legs, and at least one of the support legs has a shaped sheet metal part to dissipate an electrostatic charge from the inner container, which is enclosed in the outer casing and disposed on the bottom, a contact conductor section at an end of the shaped sheet metal part closest to the inner container having a container contact section for electrically conductive connection with the bottom or the outer casing, and a standing contact section for electrically conductive connection with a standing surface at an end closest to a standing surface, wherein the contact conductor section of the shaped sheet metal part extends inside an accommodating cavity in the support leg and the standing contact section has a contact surface arrangement with a ground contact surface and a stack contact surface, wherein the stack contact surface is connected to the ground contact surface by a contact surface offset element in the standing contact section and is arranged above the ground contact surface in a direction of a vertical axis of the container, wherein the container contact section is a fastening means for fastening the shaped sheet metal part to the support leg, said container contact section being a flexible tongue that passes through a fastening slot in a supporting base of the support leg and is bent towards the supporting base that the container contact section is held firmly between the supporting base and the bottom.

2. The container as recited in claim 1, wherein the end of the support leg closest to the standing surface has a bracing surface arrangement conformed to match the contact surface offset element in order to brace the standing contact section.

3. The container as recited in claim 1, wherein the shaped sheet metal part is substantially L-shaped, wherein the standing contact section extends at an angle to the contact conductor section of the shaped sheet metal part, and the container contact section is constructed as a continuation on an abutment end of the contact conductor section opposite the standing contact section.

4. The container as recited in claim 3, wherein the standing contact section is braced on frontal edges of cavity walls of the accommodating cavity.

5. The container as recited in claim 4, wherein the connecting edge of the standing contact section with the contact conductor section and a free outer edge thereof opposite the connecting edge are provided with retaining devices for fixing a position of the standing contact section in the accommodating cavity.

6. The container as recited in claim 5, wherein the retaining devices allocated to the connecting edge are detent devices arranged along longitudinal edges of the contact conductor section, and form a positive and non-positive locking connection with the cavity walls of the accommodating cavity.

7. The container as recited in claim 5, wherein the retaining devices allocated to the free outer edge are cleats constructed as material extensions on the free outer edge that extend parallel to the longitudinal edges of the contact conductor section.

8. The container as recited in claim 5, wherein standing contact section fins on transverse edges extend between the connecting edge and the outer edge, which fins are inclined towards the container contact section opposite a contact plane of the ground contact surface and the stack contact surface.

9. The container as recited in claim 8, wherein the connecting edge of the standing contact section has bearing flanges that each extend parallel to the longitudinal edges of the contact conductor section, and which are separated by cutouts for seating the cavity walls of the accommodating cavity and with a reinforcing edge lie flush with an underside of the support base for bracing the transverse edges of the standing contact section.

10. A transport and storage container for liquids, comprising:

an inner container made of plastic;

an outer casing made of a metal mesh or sheet metal; and an underframe constructed as a pallet configured to be manipulated by a lifting truck, a shelf operating device or similar transport device, wherein the underframe has a bottom for supporting the inner container, and support legs made from an electrically non-conductive material, wherein the bottom is arranged with a peripheral edge between a bottom edge of the outer casing and the support legs, and at least one of the support legs has a shaped sheet metal part to dissipate an electrostatic charge from the inner container, which is enclosed in the outer casing and disposed on the bottom, a contact conductor section at an end of the shaped sheet metal part closest to the inner container having a container contact section for electrically conductive connection with the bottom or the outer casing, and a standing contact section for electrically conductive connection with a standing surface at an end closest to a standing surface, wherein the contact conductor section of the shaped sheet metal part extends inside an accommodating cavity in the support leg and the standing contact section has a contact surface arrangement with a ground contact surface and a stack contact surface, wherein the stack contact surface is connected to the ground contact surface by a contact surface offset element in the standing contact section and is arranged above the ground contact surface in a direction of a vertical axis of the container, wherein the shaped sheet metal part is substantially L-shaped, wherein the standing contact section extends at an angle to the contact conductor section of the shaped sheet metal part, and the container contact section is constructed as a continuation on an abutment end of the contact conductor section opposite the standing contact section, the standing contact section being braced on frontal edges of cavity walls of the accommodating cavity, wherein the connecting edge of the standing contact section with the contact conductor section and a free outer edge thereof opposite the connecting edge are provided with retaining devices for fixing a position of the standing contact section in the accommodating cavity, the retaining devices allocated to the connecting edge being detent devices arranged along longitudinal edges of the contact conductor section, and forming a positive and non-positive locking connection with the cavity walls of the accommodating cavity.

11. A transport and storage container for liquids, comprising:

an inner container made of plastic;

an outer casing made of a metal mesh or sheet metal; and an underframe constructed as a pallet configured to be manipulated by a lifting truck, a shelf operating device or similar transport device, wherein the underframe has a bottom for supporting the inner container, and support legs made from an electrically non-conductive material, wherein the bottom is arranged with a peripheral edge between a bottom edge of the outer casing and the support legs, and at least one of the support legs has a shaped sheet metal part to dissipate an electrostatic charge from the inner container, which is enclosed in the outer casing and disposed on the bottom, a contact conductor section at an end of the shaped sheet metal part closest to the inner container having a container contact section for electrically conductive connection with the bottom or the outer casing, and a standing contact section for electrically conductive connection with a standing surface at an end closest to a standing surface, wherein the contact conductor section of the shaped sheet metal part extends inside an accommodating cavity in the support leg and the standing contact section has a contact surface arrangement with a ground contact surface and a stack contact surface, wherein the stack contact surface is connected to the ground contact surface by a contact surface offset element in the standing contact section and is arranged above the ground contact surface in a direction of a vertical axis of the container, the shaped sheet metal part being substantially L-shaped, wherein the standing contact section extends at an angle to the contact conductor section of the shaped sheet metal part, and the container contact section is constructed as a continuation on an abutment end of the contact conductor section opposite the standing contact section, the standing contact section being braced on frontal edges of cavity walls of the accommodating cavity, wherein the connecting edge of the standing contact section with the contact conductor section and a free outer edge thereof opposite the connecting edge are provided with retaining devices for fixing a position of the standing contact section in the accommodating cavity, the retaining devices allocated to the free outer edge being cleats constructed as material extensions on the free outer edge that extend parallel to the longitudinal edges of the contact conductor section.

12. A transport and storage container for liquids, comprising:

an inner container made of plastic;

an outer casing made of a metal mesh or sheet metal; and an underframe constructed as a pallet configured to be manipulated by a lifting truck, a shelf operating device or similar transport device, wherein the underframe has a bottom for supporting the inner container, and support legs made from an electrically non-conductive material, wherein the bottom is arranged with a peripheral edge between a bottom edge of the outer casing and the support legs, and at least one of the support legs has a shaped sheet metal part to dissipate an electrostatic charge from the inner container, which is enclosed in the outer casing and disposed on the bottom, a contact conductor section at an end of the shaped sheet metal part closest to the inner container having a container contact section for electrically conductive connection with the bottom or the outer casing, and a standing contact section for electrically conductive connection with a standing surface at an end closest to a standing surface, wherein the contact conductor section of the shaped sheet metal part extends inside an accommodating cavity in the support leg and the standing contact section has a contact surface arrangement with a ground contact surface and a stack contact surface, wherein the stack contact surface is connected to the ground contact surface by a contact surface offset element in the standing contact section and is arranged above the ground contact surface in a direction of a vertical axis of the container, said shaped sheet metal part being substantially L-shaped, wherein the standing contact section extends at an angle to the contact conductor section of the shaped sheet metal part, and the container contact section is constructed as a continuation on an abutment end of the contact conductor section opposite the standing contact section, the standing contact section being braced on frontal edges of cavity walls of the accommodating cavity, the connecting edge of the standing contact section with the contact conductor section and a free outer edge thereof opposite the connecting edge being provided with retaining devices for fixing a position of the standing contact section in the accommodating cavity, wherein standing contact section fins on transverse edges extend between the connecting edge and the outer edge, which fins are inclined towards the container contact section opposite a contact plane of the ground contact surface and the stack contact surface.

* * * * *